United States Patent [19]

Mahr

[11] Patent Number: 4,499,842

[45] Date of Patent: Feb. 19, 1985

[54] SAIL CLOTH AND SAIL MADE THEREFROM

[75] Inventor: Peter F. Mahr, Fairfield, Conn.

[73] Assignee: North Sails, Inc., Pewaukee, Wis.

[21] Appl. No.: 483,913

[22] Filed: Apr. 11, 1983

[51] Int. Cl.[3] ..... B63H 9/06

[52] U.S. Cl. ..... 114/103; 139/383 R; 139/420 R

[58] Field of Search ..... 114/102, 103; D12/303, D12/304; 244/142, 145, 126; 139/420 R, 402, 413, DIG. 1, 383 R, 383 A, DIG. 1

[56] References Cited

U.S. PATENT DOCUMENTS

| | | | |
|---|---|---|---|
| 1,704,344 | 3/1929 | Riley | 139/420 R |
| 1,864,964 | 6/1932 | Vaile | 244/145 |
| 2,164,925 | 7/1939 | Kelso | 114/103 |
| 2,409,089 | 10/1946 | Whitman | 139/420 R |
| 2,619,705 | 12/1952 | Foster | 139/420 R |
| 2,696,847 | 12/1954 | Cotterill | 139/420 R |
| 3,163,185 | 12/1964 | Stanley | 139/420 R |
| 3,321,348 | 5/1967 | Rupp | 139/DIG. 1 |
| 3,356,059 | 12/1967 | Ross | 114/103 |
| 3,383,278 | 5/1968 | Helland | 139/DIG. 1 |
| 3,903,826 | 9/1975 | Andersen | 114/103 |
| 3,974,989 | 8/1976 | Goodfellow | 244/126 |
| 4,010,306 | 3/1977 | Fagan | 139/DIG. 1 |
| 4,231,401 | 11/1980 | Matuska | 139/383 A |

FOREIGN PATENT DOCUMENTS

| | | | |
|---|---|---|---|
| 1303482 | 6/1961 | France | 114/103 |
| 81394 | 3/1953 | Norway | 139/383 |
| 892528 | 3/1962 | United Kingdom | 114/103 |

OTHER PUBLICATIONS

The O'Day Company Sales Brochure, Mar. 1969, p. 11, far right picture.

*Primary Examiner*—Sherman D. Basinger
*Attorney, Agent, or Firm*—Gary, Juettner & Pyle

[57] ABSTRACT

A sail cloth is provided from a woven substrate which contains two or more warp yarns that are intersected by fill yarns in a regular or repeating pattern. In constructing the sail, the cloth is orientated such that the warp yarns are substantially parallel to the direction of maximum load. The cloth provides significantly improved tear strength and stretch resistance in comparison with conventional weaves.

5 Claims, 4 Drawing Figures

Fig. 1.
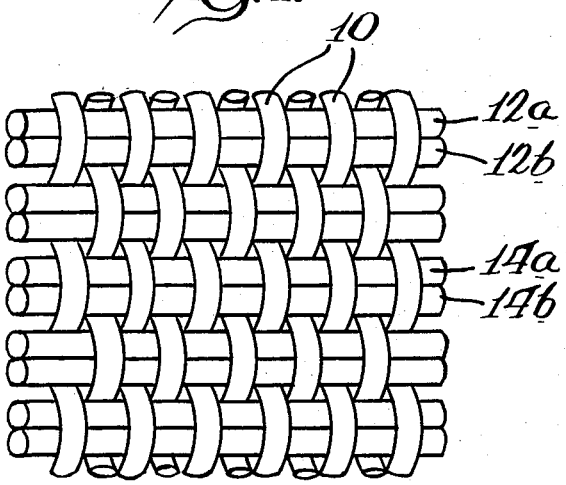
Fig. 2.
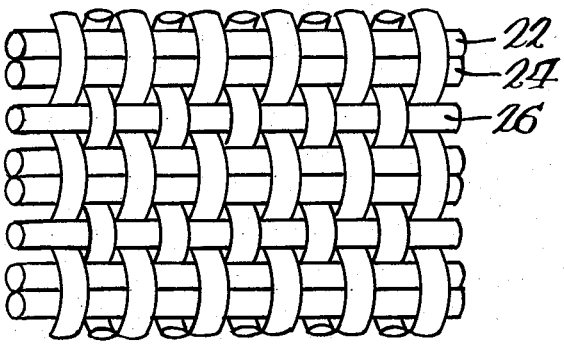
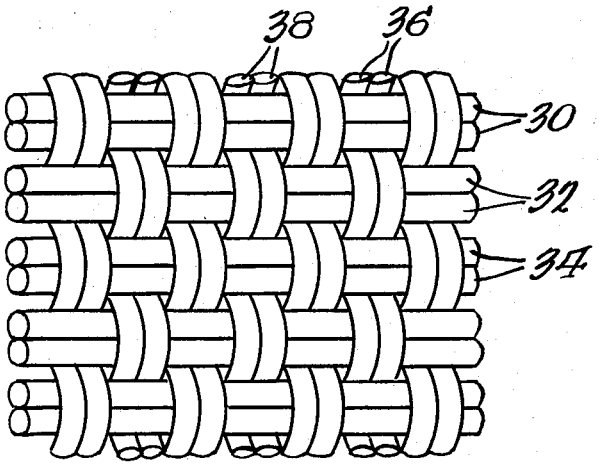
Fig. 3.
Fig. 4.
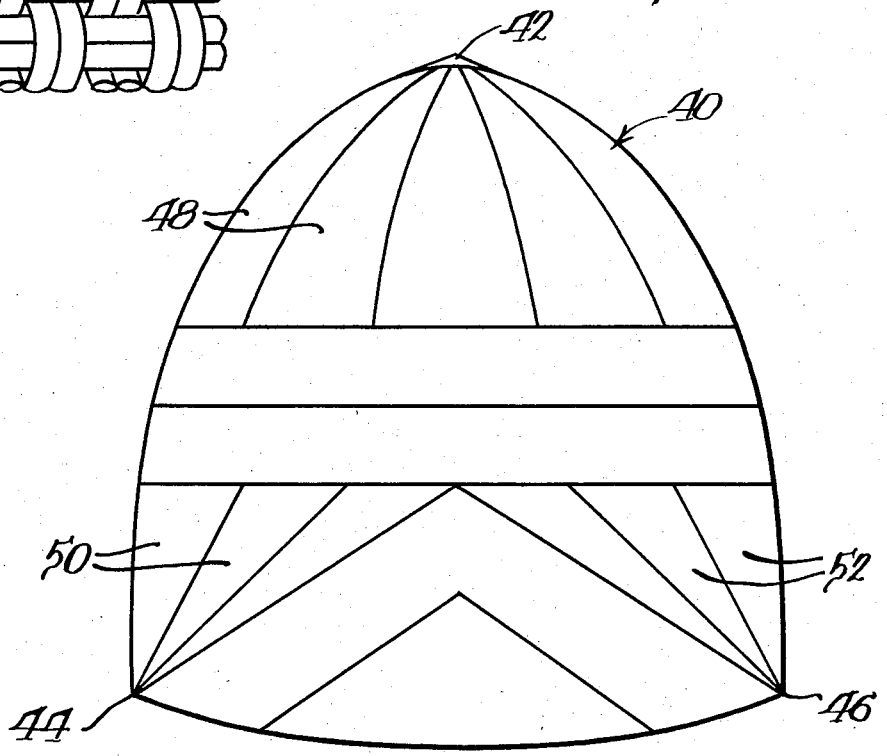

SAIL CLOTH AND SAIL MADE THEREFROM

BACKGROUND OF THE INVENTION

Conventional modern sail cloth is made from synthetic polymer yarns that are woven together in a typical fashion. In a weaving operation, a plurality of continuous yarns, called "warp" yarns, are arranged in parallel in the machine direction. A plurality of fill or weft yarns are successively passed over and under the warp yarns in a direction perpendicular to the warp yarns in order to produce a woven textile. The number of yarns or counts per inch may be varied in either direction to provide varying properties in the final cloth, and the weight of the yarns also contributes to the weight per unit area of the resulting cloth.

Conventional sails have typically been made from cloth having a so-called plain weave, in which single warp and fill yarns intersect to form a regular matrix. The final properties of the cloth have been controlled primarily by altering the counts of the respective warp and fill yarns per lineal inch and by selection of various sizes of yarns.

Some primary properties or qualities to be considered in sail cloth are stretch resistance, tensile strength and tear resistance in both the warp and fill directions. Additional qualities include diagonal stretch resistance, porosity, and flexibility for purposes of folding. In many cases, if an attempt is made to maximize certain desired properties, other properties will suffer considerably.

As an example of the foregoing, spinnaker cloth is made from plain woven nylon yarns, with the warp yarns being arranged substantially in parallel with the direction of maximum load on the sail. In order to provide adequate strength in the warp direction, it has been proposed to increase the count of warp yarns relative to the count of the fill yarns. While this measure does in fact increase warp strength, the warp tear resistance is significantly reduced. This is presumably, due to the tight packing of the warp yarns in the weave, which decreases the mobility of such yarns. The less mobile yarns cannot move, bunch up or realign themselves sufficiently under conditions of tear and are therefore are more prone to individual rupture and tear failure.

In connection with other types of sail cloths, it may be desirable to increase either tear or stretch resistance in areas of high stress on the cloth without excessive compromise to the other properties, and in many cases, it would be impossible or impractical to do so with conventional plain woven cloths.

SUMMARY OF THE INVENTION

In accordance with the present invention, a sail cloth is prepared from a woven material which is characterized by the fill yarns being woven over and under two or more warp yarns in a regular or repeating pattern, the extent of which will be described more fully herein. The plural adjacent warp yarns are more mobile than individual yarns, resulting in significantly improved tear resistance. At the same time, the two yarns in effect provide a double size yarn, thereby furthering augmenting tear resistance. In addition, the material is more stretch resistant, in that the plural warp yarns are bent or deflected less severely than would be the case with single warp yarns.

THE DRAWING

FIGS. 1, 2, and 3 are enlarged views of pieces of the woven sail cloth of the present invention illustrating three of the possible weaves.

FIG. 4 is a plan view of a spinnaker sail made from the sail cloth of the present invention.

DESCRIPTION OF THE PREFERRED EMBODIMENTS

FIG. 1 illustrates the preferred sail cloth of the present invention wherein the yarns are made from fibers of synthetic polymers, such as polyesters, polyamids, and the like. As shown, the cloth comprises fill yarns 10 that are woven over and under successive adjacent pairs of warp yarns, such as 12*a* and 12*b*, and 14*a* and 14*b*. When incorporated into a sail, the warp yarns are preferably arranged in a direction substantially or approximately aligned with the direction of highest load to be experienced in the particular area of the sail. In terms of sail manufacture, the term "substantially aligned" may include deviations of up to about 45 degrees because of the multiple forces exerted on a sail under working conditions.

Various patterns of multiple warp yarns may be employed, depending on the properties which may be desired in the final cloth. If (r)-(t)-(v) represent adjacent sectors of a number of contiguous adjacent warp yarns, and the hyphens therebetween represent fill yarns designated as (n), then the possible weaves are defined as a repeating pattern of numbers of yarns wherein:

(r) is equal to 1, 2, or 3;

(t) is equal to 2 or 3; and (v) is zero or optional or is equal to 1 or 2; wherein (n) is 1 or 2.

The foregoing formula defines a number of possible repeating patterns of warp yarns in which at least every third sector contains a minimum of two adjacent warp yarns between the bounding fill yarns.

The use of greater than three warp yarns in a single sector is impractical, since the cloth may not exhibit sufficient diagonal stretch resistance to be useful. In some applications also, the use of a 3 to 2 warp to fill pattern may result in excessive porosity and diagonal stretch unless the cloth is additionally supported, such as by laminating the cloth to a continuous plastic film.

FIGS. 2 and 3 illustrate additional weave patterns within the foregoing framework. In FIG. 2, single fill yarns are woven with warp yarns 22, 24, and 26 in a repeating pattern of 2-1-2-1-2. In FIG. 3, the warp yarns 30, 32, and 34 follow the number sequence 2-2-2 and are intersected by fill yarns 36 and 38 in the repeating pattern of 2-2-2.

FIG. 4 illustrates a spinnaker sail 40 of the so-called tri-radial type, in which the sail is supported from three corners 42, 44, and 46. Respective series of tapered panels 48, 50, and 52 radiate from the corners 42, 44, and 46 substantially toward a central portion of the sail. The seams between adjacent panels substantially aligned with the direction of maximum load on the sail when in use. The sail cloth of the present invention is oriented in the sail such that the warp yarns are substantially aligned with the direction of maximum load, i.e., generally parallel to the seams.

When the sail cloth of the present invention is used as aforesaid, several advantages become apparent, namely resistance to tear is enhanced and stretch resistance is increased along the lines of maximum effort exerted on the sail. Moreover, these improvements are realized without undue detriment to the other properties of the sail.

In addition to the use shown in FIG. A, the sail cloth may be used in other types of sails, such as jibs or genoas, mainsails and the like. The cloth may also be laminated to polymer films, such as polyesters, and then fabricated into a sail.

I claim:

1. A sail which is subject to a maximum load in a given direction, said sail comprising a woven cloth having warp yarns intersecting fill yarns, said warp yarns being arranged in adjacent sectors of a repeating pattern designated by the letters (r)-(t)-(v), wherein the letters represent the number of yarns in each respective sector, and hyphens represent a number of fill yarns at each intersection corresponding to (n), and wherein (r), (t), (v) and (n) are equal to the following numbers of yarns and combinations of said numbers in each designation as follows:

(r) is one, two or three,
(t) is two, or three,
(v) is zero, one or two,
(n) is one or two, said cloth being oriented in said sail such that said warp yarns are substantially aligned in said direction of maximum load whereby to improve stretch resistance in said direction.

2. The sail of claim 1 wherein (r), (t) and (v) are equal to 2 and (n) is equal to 1.

3. The sail of claim 1 wherein said woven cloth is laminated to polymer film.

4. The sail in claim 1 wherein said sail includes a corner having a plurality of panels radiating therefrom and being joined together with seams, and wherein said seams are generally aligned with said warp yarns.

5. The sail of claim 1 wherein (r) is equal to 1, (t) is equal to 2, (v) is equal to zero, and (n) is equal to 1.

* * * * *